US006363664B1

(12) United States Patent
Brutsaert

(10) Patent No.: US 6,363,664 B1
(45) Date of Patent: Apr. 2, 2002

(54) COLLAPSIBLE CANOPY WITH AN AUTOMATIC EXTENDING FLOUNCE

(75) Inventor: Louis Marcel Brutsaert, Menen (BE)

(73) Assignee: Brutsaert Sunprotection naamloze vennootschap (BE)

( * ) Notice: Subject to any disclaimer, the term of this patent is extended or adjusted under 35 U.S.C. 154(b) by 0 days.

(21) Appl. No.: 09/635,588

(22) Filed: Aug. 9, 2000

(30) Foreign Application Priority Data

Aug. 11, 1999 (FR) ..... 99 10403

(51) Int. Cl.[7] ..... E04B 7/16

(52) U.S. Cl. ..... 52/74; 135/117; 135/119; 52/63; 52/69; 52/74; 52/72; 160/22; 160/70

(58) Field of Search ..... 52/63, 69, 72, 52/74, 202, 783.13, 73; 135/117, 119; 160/22, 70

(56) References Cited

U.S. PATENT DOCUMENTS

| | | | | | |
|---|---|---|---|---|---|
| 3,620,564 | A | * | 11/1971 | Wanger et al. | 296/23 |
| 3,782,443 | A | * | 1/1974 | Clauss et al. | 160/22 |
| 3,800,484 | A | * | 4/1974 | Marshall | 52/69 |
| 3,923,074 | A | * | 12/1975 | McKee | 135/5 |
| 3,991,805 | A | * | 11/1976 | Clauss | 160/22 |
| 4,733,683 | A | * | 3/1988 | Pozzi | 135/89 |
| 4,997,021 | A | * | 3/1991 | Brutsaert | 160/22 |
| 5,232,036 | A | * | 8/1993 | Brutsaert | 160/70 |
| 5,369,919 | A | * | 12/1994 | Lohausen | 52/73 |

FOREIGN PATENT DOCUMENTS

| | | |
|---|---|---|
| DE | 3440446 | 5/1986 |
| DE | 8417475 | 5/1988 |

* cited by examiner

*Primary Examiner*—Carl D. Friedman
*Assistant Examiner*—Dennis L. Dorsey
(74) *Attorney, Agent, or Firm*—Bacon & Thomas, PLLC

(57) ABSTRACT

A collapsible awning having an automatic extending flounce is divided into a first portion spanning an awning casing and a primary front section, and a second portion spanning a flounce area between the primary front section and a secondary front section. Awning cloth suspended at one end by the awning casing extends across both the primary and the secondary front sections. Articulated arms connected to the awning casing in the primary front section maintain the front section spaced away distally from the casing when the awning is unfolded and the main part of the awning is stretched. Spring elements connected to the primary front section and the secondary front section maintain the secondary front section located outward away from the primary front section at an angle relative thereto and the flounce portion of the awning cloth between the primary front section and the secondary front section is maintained stretched as well when the awning is extended.

9 Claims, 4 Drawing Sheets

COLLAPSIBLE CANOPY WITH AN AUTOMATIC EXTENDING FLOUNCE

BACKGROUND OF THE INVENTION

1. Field of the Invention

The present invention concerns a collapsible canopy with an automatic extending flounce.

In particular, the invention concerns a canopy which consists at least of a casing for the canopy which can be fixed to a wall or the like; of a cloth which can be rolled up in the casing of the canopy; of at least a first pair of articulated arms which is fixed between the casing of the canopy and that what is called a primary front support section, by means of which, as is known, the articulated arms constantly keep the cloth firmly stretched between the casing of the canopy and the primary front support section, and of a second pair of articulated arms which are fixed between the above-mentioned primary front support section and a secondary front support section, and which form an angle in relation to the above-mentioned first pair of articulated arms, wherein the free end of the cloth is fixed to the secondary front support section, such that an automatic extending flounce is obtained.

2. Discussion of the Related Art

However, this second pair of articulated arms between the primary front support section and the secondary front support section is disadvantageous in that it requires much space when the canopy is rolled up, as a result of which the casing of the canopy must be slightly larger.

Moreover, articulated arms of this type are not easy to build, such that these articulated arms are also relatively expensive, which represents considerable extra costs for the canopy.

SUMMARY OF THE INVENTION

The present invention comprises a collapsible canopy with an automatic extending flounce which does not have the above-mentioned disadvantages associated with known canopies of this type with automatic flounces, and which is advantageous in that it offers a good protection against the blinding light of the sun which stands low on the horizon, and is also easy to manufacture and does not require much space either when the canopy is rolled up.

To this end, the invention concerns a collapsible canopy with an automatic flounce which comprises a casing for the canopy which can be fixed to a wall or the like; of a cloth which can be rolled up in and suspended by the casing; of at least one pair of articulated arms which is fixed between the casing of the canopy and a primary front section; and of at least two Connections fixed between the above-mentioned primary front section and a secondary front section, by means of which the free end of the cloth is fixed to the secondary front section and extends in front of the actual front section, wherein the above-mentioned connections between the primary front section and the secondary front section comprise spring elements.

Normally, these spring elements or springs will be gas pressure springs; however, it is not excluded to use compression springs in a particular embodiment.

According to a first embodiment, the springs will be gas pressure springs which are hinge-mounted to the primary front section on the one hand and to the secondary front section on the other hand, such that the gas pressure springs are fixed so they form an angle in relation to the respective front sections.

According to a second embodiment, the above-mentioned springs can be mounted on two elements which can move in relation to one another, wherein one of these elements is connected to the primary front section, and the second element is connected to the secondary front section.

Preferably, the above-mentioned elements consist of elements which can move in a telescopic manner in relation to one another, in the shape of tubes in which the above-mentioned springs are mounted.

BRIEF DESCRIPTION OF THE DRAWINGS

In order to better explain the characteristics of the invention, the following preferred embodiment according to the invention is described as an example only without being limitative in any way, with reference to the accompanying drawings, in which.

DESCRIPTION OF THE PREFERRED EMBODIMENT

Figure 1:
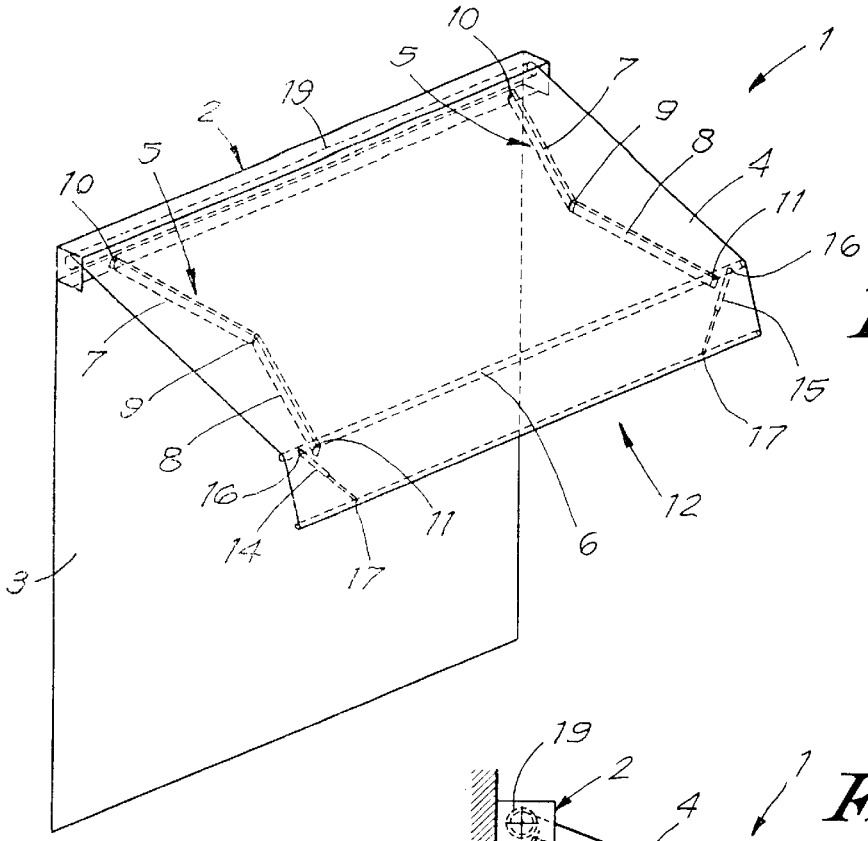
FIG. 1 schematically represents a view in perspective of a collapsible canopy with an automatic flounce according to the invention.
Figure 2:
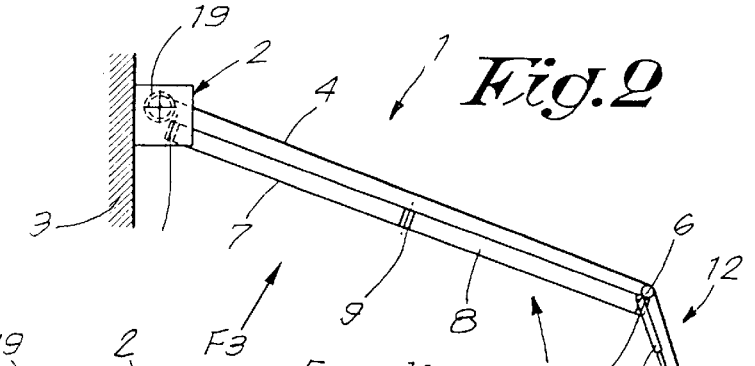
FIG. 2 represents a side view of a canopy according to FIG. 1.
Figure 3:
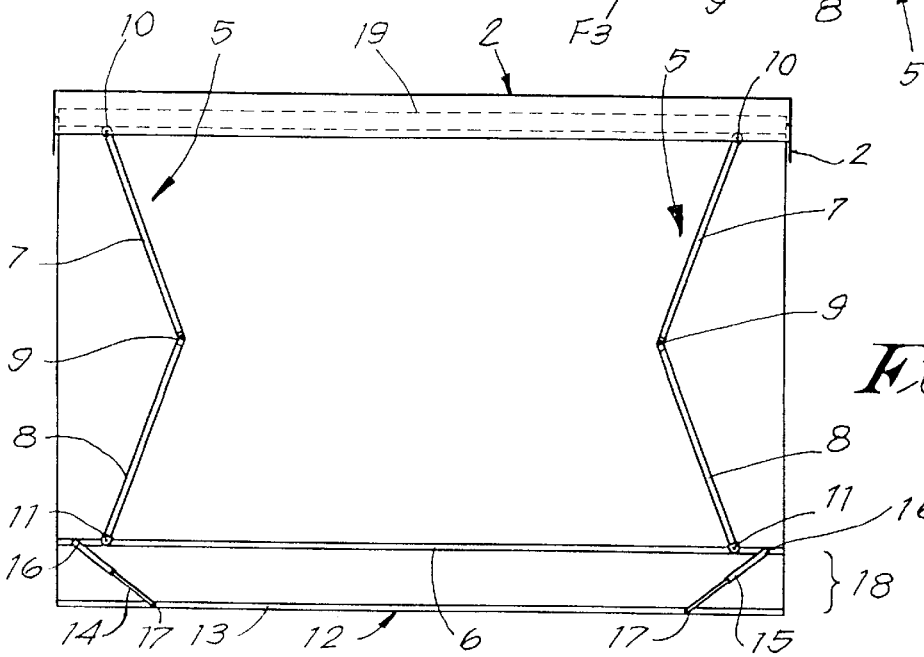
FIG. 3 represents a view according to arrow F3 in FIG. 2.

FIGS. 1 to 3 represent a collapsible canopy 1 in a very schematic manner, which mainly consists of an awning casing for canopy 2 which can be fixed to a wall 3, an awning cloth 4 which is mounted such that it can be rolled up in and supported by the casing of canopy 2, and two articulated arms 5 which are fixed at one (proximal) end to the casing of canopy 2, and are connected at their distal ends to a primary front section 6.

Articulated arms 5 which are known as such include proximal and distal parts 7–8 respectively which are connected to one another by means of a hinged joint 9, and wherein the proximal and distal ends of these articulated arms 5 are also connected by means of proximal and distal hinged joints 10 and 11 to the case of canopy 2 and to the primary front section 6, respectively. Further, as is known, articulated arms 5 are provided with springs which ensure that the primary front section 6 is being continuously pushed away from the case of canopy 2 during and after the unrolling of cloth 4. The far end 12 of cloth 4 is fixed to a secondary front section 13 according to the invention, which is connected to the primary front section 6 by means of two connecting parts each consisting of gas pressure springs 14 and 15.

It is clear that the invention is not restricted to the use of gas pressure springs; any other type of springs can be adapted, making it possible to push the primary front section 6 and secondary front section 13 away from one another as the cloth 4 is being unrolled.

According to another embodiment, the gas pressure springs 14 and 15 can be replaced, for example by helical springs which are mounted in telescopic elements which can be moved in relation to one another.

According to yet another embodiment, the above-mentioned elements can simply move along and next to one another instead of one inside the other.

The above-mentioned gas pressure springs 14–15 are connected to the primary front section 6, and to the secondary front section 13 respectively, by means of hinged joints 16–17, and the gas pressure springs 14–15 are mounted such that the hinged joints 16 are situated closer to the far ends of the primary front section 6 than the hinged joints 17 in relation to the respective far ends of the secondary front section 13.

The hinged joints 16 may include spherical plain bearings 30 which are mounted such that the flounce 18 can be unrolled while forming the desired angle in relation to the plane in which the articulated arms 5 unfold.

According to a more sophisticated embodiment, the hinged joints 16 may also include supplementary spherical plain bearings which can be provided on both the far ends of the gas pressure springs 14–15, such that the angle formed by the flounce 18 can be adjusted and can be locked in relation to the actual front section 6, for example by means of a locking screw.

The casing of the canopy 2 is always well locked, thanks to the combination of the primary front section 6 and the secondary front section 13, when the cloth 4 of the canopy is rolled up.

The force with which the gas pressure springs 14–15 push the secondary front section 13 away from the primary front section 6 is less than the force with which the primary front section 6 is pushed away from the casing of the canopy 2. This has for a result that, when the cloth 4 is unrolled, the articulated arms 5 will unfold first, and it is only then that the gas pressure springs 14–15 will extend.

Inversely, when the cloth 4 is rolled up, the gas pressure springs 14–15 will be initially compressed, and it is only afterwards that the articulated arms 5 will fold up.

As represented in FIGS. 4 to 8, the cloth 4 is rolled up 20 on a roller 19 which is suspended in the casing of the canopy 2.

Figure 4:
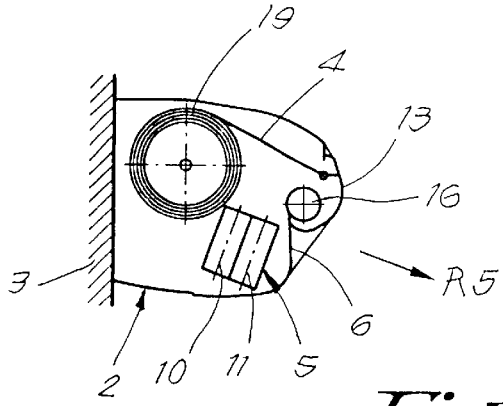
FIG. 4 schematically represents a side view of a canopy with an automatic flounce according to the invention, in which the canopy is rolled up.
Figure 7:
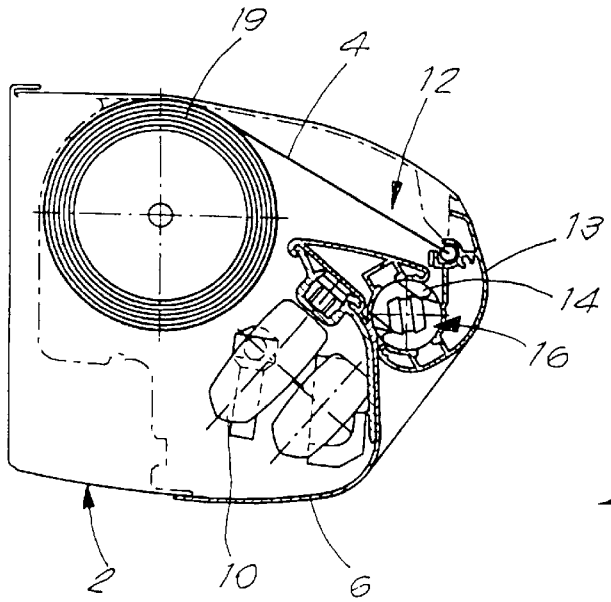
FIG. 7 represents a detailed side view of a canopy according to the invention in which the canopy is rolled up.
Figure 8:
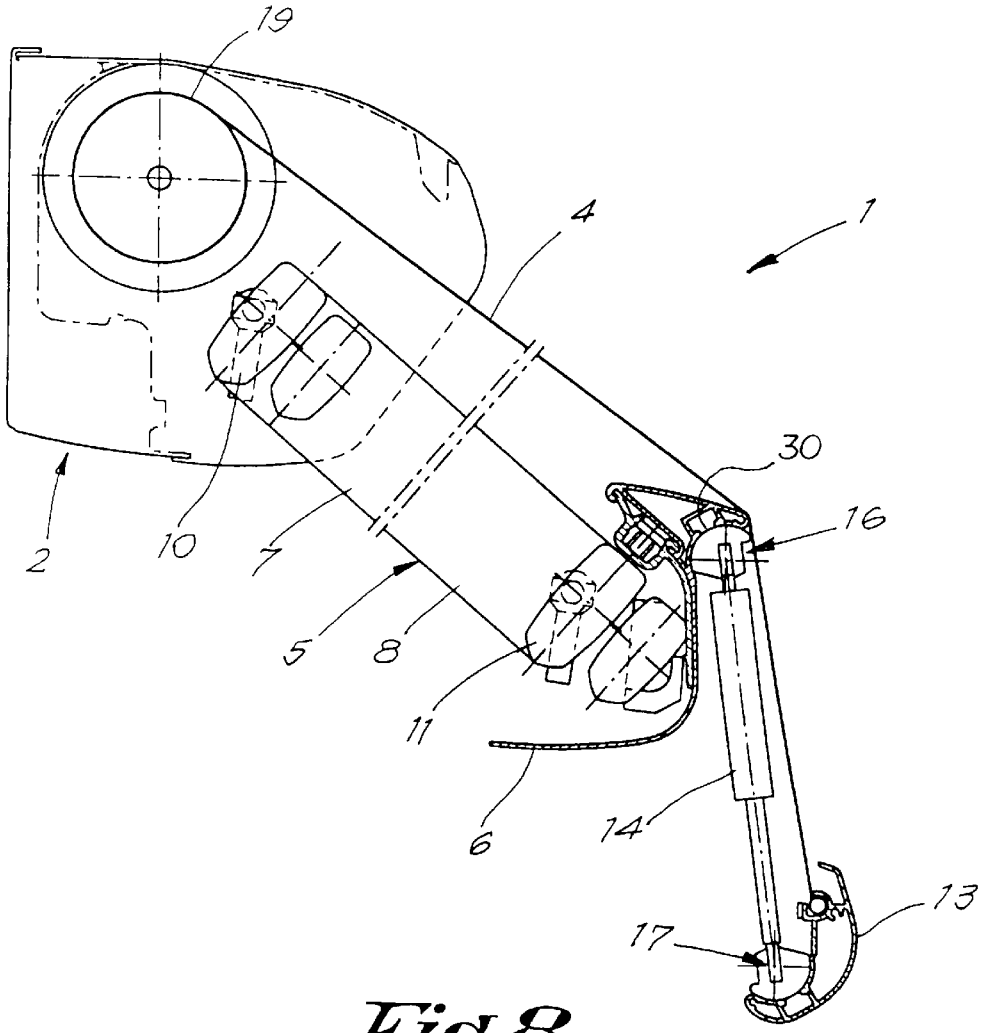
FIG. 8 represents a view analogous to that in FIG. 7, in which the canopy has been entirely rolled off.

When the cloth 4 has been rolled up, the casing 2 of the canopy 1 is closed thanks to the combination of the primary front section 6 and the secondary front section 13, as shown in FIGS. 4 and 7.

It is clear that, although the front sections 6 and 13 do not necessarily have to close the casing of the canopy 2, this embodiment is preferred.

When the cloth 4 is unrolled in the direction indicated by the arrow R5 in FIG. 4, the articulated arms 5 fold up under the pressure exerted by the springs which are mounted in or on the above-mentioned arms, such that the cloth 4 remains stretched between the casing of the canopy 2 and the secondary front section 13. This phase is represented in FIG. 5.

Figure 5:
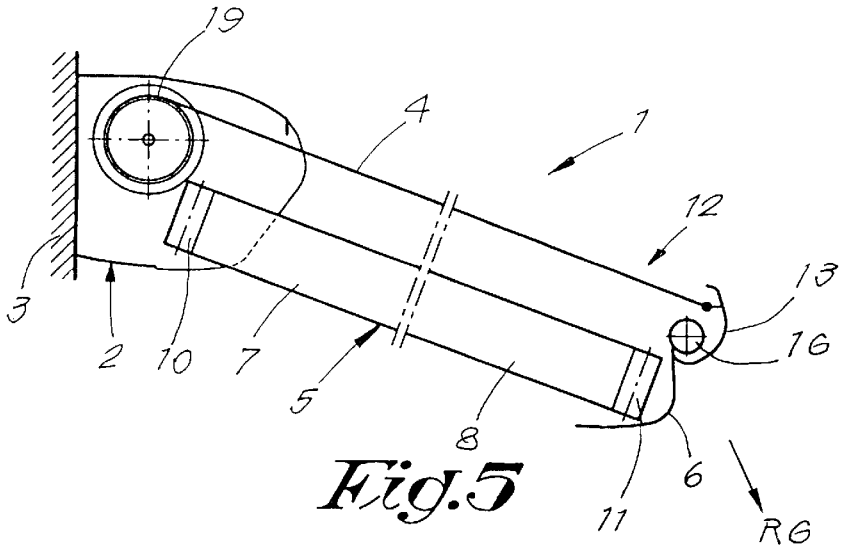
FIGS. 5 and 6 represent the canopy according to the invention in which the flounce has been placed in different typical positions.
Figure 6:
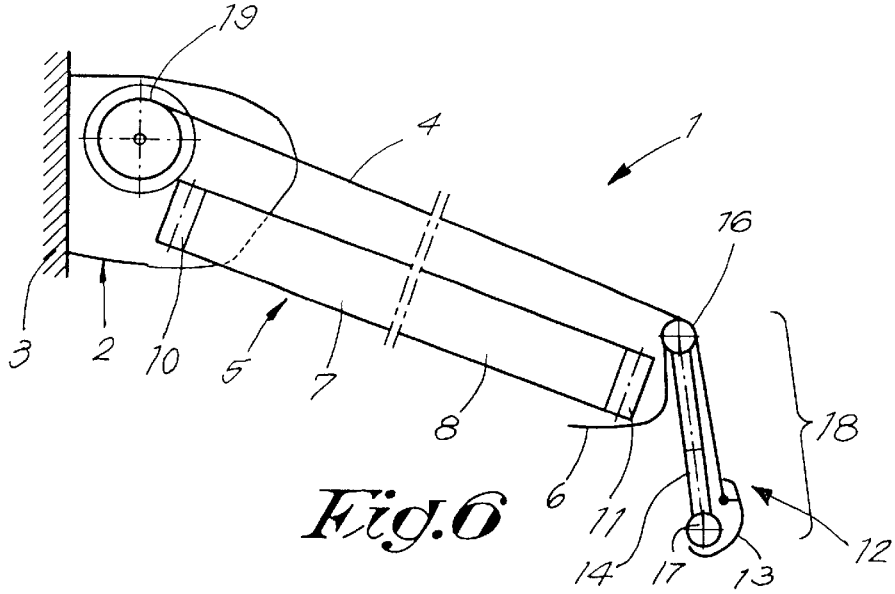

When the cloth 4 is unrolled then, as indicated by the arrow R6 in FIG. 5, the gas pressure springs 14–15 make sure that the secondary front section 13 is pushed away from the primary front section 6, such that the cloth 4 also remains stretched in this position, as represented in FIG. 6.

As the cloth 4 is firmly stretched between the casing of the canopy 2 and the secondary front section 13, while being supported by the primary front section 6, the cloth 4 acquires a shape consisting of two surfaces which are directed towards one another and thus forming an obtuse angle, such that a collapsible canopy 1 is obtained which also provides protection against the sun light when the sun is standing low on the horizon, and which is built in a simple and compact manner.

Figure 9:
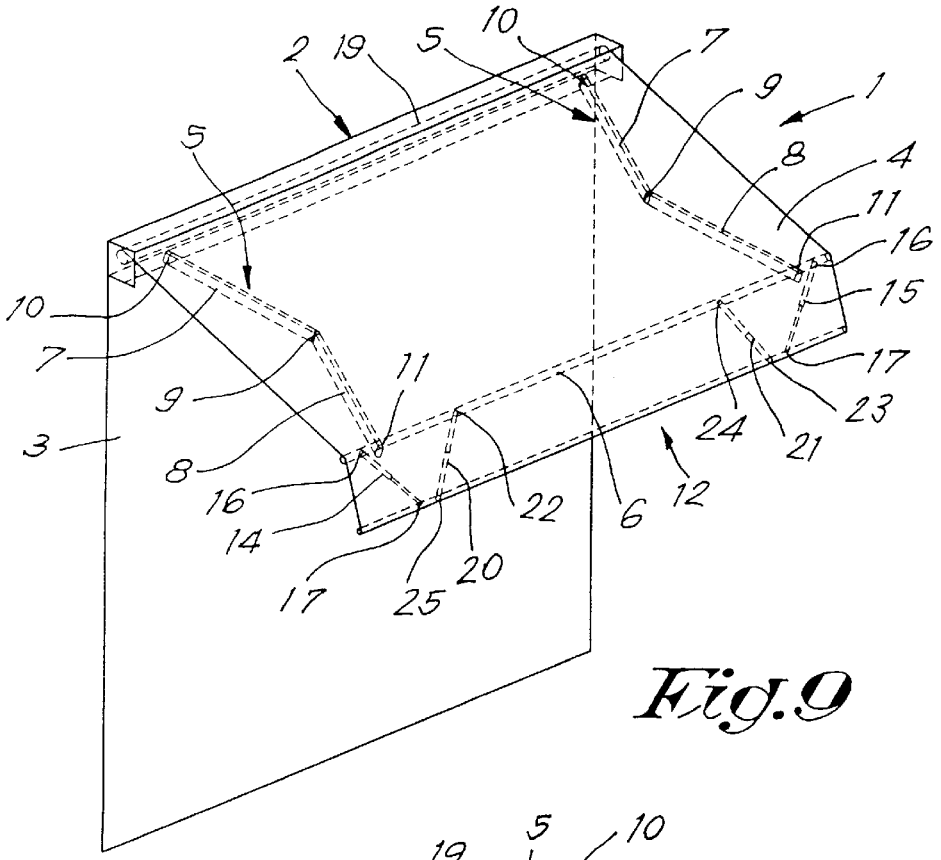
FIGS. 9 and 10 represent views which are similar to that in FIG. 1, but for variants of the embodiment.

FIG. 9 represents another variant of the canopy according to the invention in which are provided, between the primary front section 6 and the secondary front section 13, two rods, 20–21 respectively, fixed to said sections 6–13 by means of moveable joints 22-23-24-25, at a certain angle so as to prevent said sections 6–13 from carrying out a relative movement in the longitudinal direction.

Figure 10:
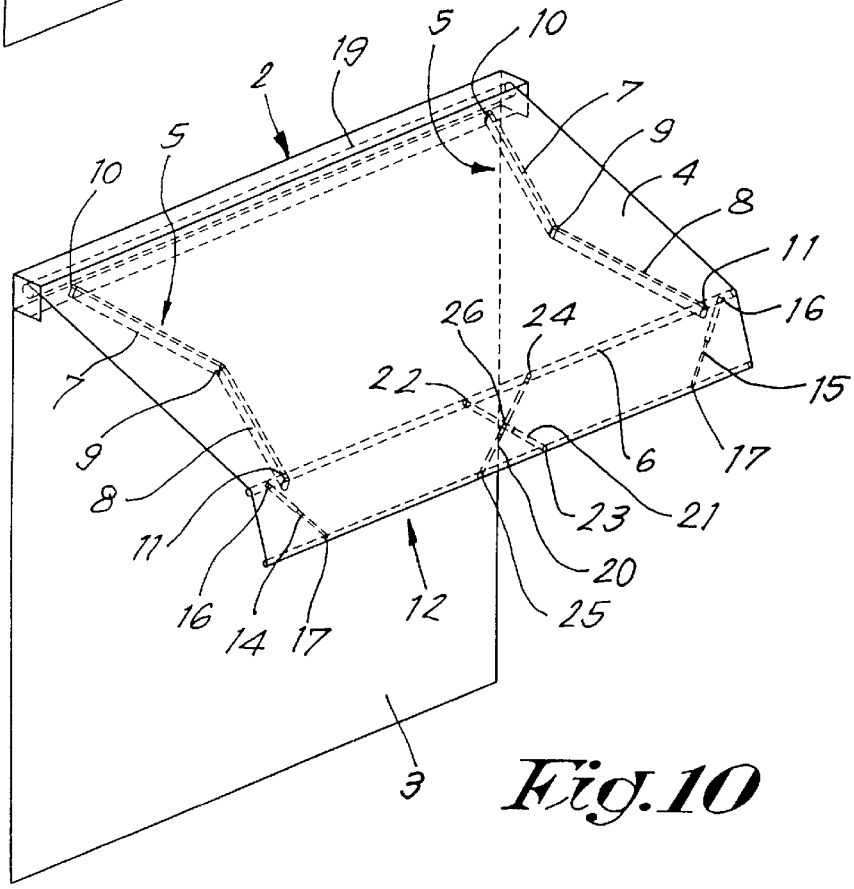

According to the preferred embodiment from FIG. 10, said rods 20–21 are formed in the parts fixed to one another by means of a joint 26 so the parts are articulated.

The rods 20–21 also may consist of springs, for example gas pressure springs.

The invention is by no means limited to the above-described embodiments represented in the accompanying drawings; on the contrary, such a canopy can be made in all sorts of shapes and dimensions while still remaining within the scope of the invention.

What is claimed is:

1. A collapsible canopy having an automatic extending flounce comprising:

an awning casing;

an awning cloth arranged to be rolled up in and unrolled from the awning casing, said cloth supported at one end at the casing;

a primary front section over which the awning cloth extends at an area distally away from the casing;

at least one pair of articulated arms, each arm including a distal part having one end hingedly connected to a secondary front section and an opposed end connected to a proximal part of said arm; said proximal part of each arm having one end hingedly connected to said distal part and an opposed end connected to said awning casing;

of said secondary front section locatable distally beyond and below said primary front section, a free end of the awing cloth connected to said secondary front section; and at least two spring connecting parts which are each connected at one end to said primary front section and at another end to said secondary front section, wherein the awning cloth spanning the area between said primary front section and said secondary front section forms a flounce portion of the awning, said at least two spring connecting parts maintaining said secondary section spaced away from said primary front section and the flounce portion of said awning cloth stretched when said awning cloth is unrolled from said awning casing.

2. The collapsible canopy of claim 1, wherein said at least two spring connecting parts are gas pressure springs.

3. The collapsible canopy of claim 1, wherein said at least two spring connecting parts are pressure springs having telescoping elements.

4. The collapsible canopy of claim 1, wherein said at least two spring connecting parts each comprise relatively slidable elements.

5. The collapsible canopy of claim 1, wherein said at least two spring connecting parts each include hinged joints disposed at opposed first and second ends thereof connected respectively to said primary front section and said secondary front section, respectively.

6. The collapsible canopy of claim 5, wherein said hinged joints include spherical bearings arranged to fixedly establish an adjustable sloping angle of said flounce relative to said primary front section when said awning cloth is unrolled from said awning casing.

7. The collapsible canopy of claim 1, said casing having a front opening, said primary and secondary front sections dimensioned and configured to collectively cover said opening when the awning is rolled up in the casing.

8. The collapsible canopy of claim 1, further comprising at least two rods pivotally connected at opposed ends thereof to said primary front section and said secondary front section, said rods inclined relative to the extending direction of the awning during unfolding, and configured so that the primary and secondary front sections are constrained by said rods against movement relative to each other in directions transverse to the awning unfolding direction.

9. The collapsible canopy of claim 8, wherein each of said rods comprise two portions connected together between their respective opposed ends by hinged joints so the rod portions are articulated relative to each other.

* * * * *